US005115642A

United States Patent [19]

Cvelbar et al.

[11] Patent Number: 5,115,642

[45] Date of Patent: May 26, 1992

[54] GAS TURBINE ENGINE CASE WITH INTERGRAL SHROUD SUPPORT RIBS

[75] Inventors: David A. Cvelbar, Rocky Hill, Conn.; Anthony Rubino, Wenham, Mass.

[73] Assignee: United Technologies Corporation, Hartford, Conn.

[21] Appl. No.: 637,904

[22] Filed: Jan. 7, 1991

[51] Int. Cl.[5] ..... F02C 3/04

[52] U.S. Cl. ..... 60/751; 415/191

[58] Field of Search ..... 60/39.75, 751; 415/191, 415/209.3, 209.2, 192, 193, 194, 195

[56] References Cited

U.S. PATENT DOCUMENTS

| | | | |
|---|---|---|---|
| 2,622,790 | 12/1952 | McLeod | 415/209.3 |
| 2,857,093 | 10/1958 | Warnken | 415/209.3 |
| 3,393,436 | 7/1968 | Blackhurst et al. | 415/209.3 |
| 3,565,545 | 2/1971 | Bobo et al. | 60/39.75 |
| 4,190,397 | 2/1980 | Schilling et al. | 415/112 |
| 4,466,239 | 8/1984 | Napoli et al. | 60/39.75 |
| 4,870,826 | 10/1989 | Daguet et al. | 60/751 |
| 4,907,946 | 3/1990 | Ciokajlo et al. | 415/209.3 |
| 5,024,581 | 6/1991 | Foucher | 415/209.1 |

FOREIGN PATENT DOCUMENTS

| | | | |
|---|---|---|---|
| 151356 | 12/1961 | U.S.S.R. | 415/191 |

*Primary Examiner*—Richard A. Bertsch
*Assistant Examiner*—Timothy S. Thorpe
*Attorney, Agent, or Firm*—Edward L. Kochey, Jr.

[57] ABSTRACT

Inner case 14 is supported from outer case 12 through combined vanes 32. Substantial torque loading is transferred leading to high stress levels at the roots of the vanes. Shrouds 22, 28 are thinned between support ring 20 and conical portion 18. Ribs 48 are located coincident with the radial extension of the vanes 32. With the cambered vanes the high stress location is remote from the vane ends, and flexibility is achieved at such location.

5 Claims, 4 Drawing Sheets

GAS TURBINE ENGINE CASE WITH INTERGRAL SHROUD SUPPORT RIBS

The Government has rights in this invention pursuant to a contract awarded by the Department of the Air Force.

TECHNICAL FIELD

The invention relates to gas turbine engines and in particular to a construction for carrying an inner diffuser case from an outer diffuser case through diffuser guide vanes.

BACKGROUND OF THE INVENTION

In gas turbine engines air passes from the compressor through a pressure recovery diffuser enroute to the combustor. The diffuser case has an outer case and an inner case forming an annular flowpath between them. Since they surround the rotor shaft, the inner case must be supported from the outer case. Sometimes struts are used between the two case sections with this introducing weight and interference with the gas flow.

Cambered airfoil vanes are used at the upstream end of the diffuser to straighten rotating airflow leaving the compressor. These are connected to an upstream extending shroud on both the outer and inner cases. They offer opportunity for support provided reasonable stress levels can be achieved.

Complex loading is imposed on such vanes, however. The inner case imposes a high axial load towards the downstream end, imposing high axial loading through the vanes. A circumferential force is imposed on the vanes because of the differential pressure between the pressure and suction side of each vane. There furthermore is a high torque loading caused by rotational forces on the inner case. This causes a circumferential shear loading on the vanes.

The high axial load is substantially in the plane of the vanes. The shroud case can be made stiff to take this load without excessive stress. The side loading caused by the pressure on the vanes is relatively insignificant and is added to the circumferential load. The circumferential load or torque load causes the vane to resist the loading as a fixed end beam in shear. Therefore, high bending stresses exist at the end points. Decreasing the shroud thickness would permit rotation at the end of the vanes thereby decreasing the bending stresses, but in such a case the axial load could not be tolerated by the reduced thickness shroud.

The vanes are not flat, but are cambered airfoils. High stress, therefore is found not uniformly along the vanes, but at locations on the order of 25 to 30 percent from each end.

SUMMARY OF THE INVENTION

The inner circumferential case and the outer circumferential case each have shroud portions at the upstream end. The shroud portions are joined to the downstream end of the case with conical case portions. Each shroud portion has a support ring at the end opposite the conical case portion with an intermediate shroud portion therebetween. A diffuser is formed of downstream extensions of the shroud portion.

A plurality of cambered vanes connect the shroud portions. The upstream end of the vanes are coextensive with the support ring and the downstream end of the vanes are coextensive with a portion of the conical section. The thickness of the intermediate shroud portion is limited and does not exceed the maximum thickness of the vanes. Integral ribs on each side of each intermediate shroud portion are located on the side away from the vanes and are coincident with radial extension of the vanes.

Stiffness and strength in taking the axial loading is achieved because of the rigid nature of the support ring, the conical portion and the ribs themselves. Local deflection is achieved by the flexibility of the intermediate shroud portion, this being in the area where the cambered vanes tend to otherwise have the high bending stresses; for instance, 20 to 30 percent of the length from each end. In an overall rigid structure high stress can be relieved by relatively minor deflection in a local area. A finite element analysis has confirmed that this is such an occasion.

DESCRIPTION OF THE PREFERRED EMBODIMENT

Figure 1:
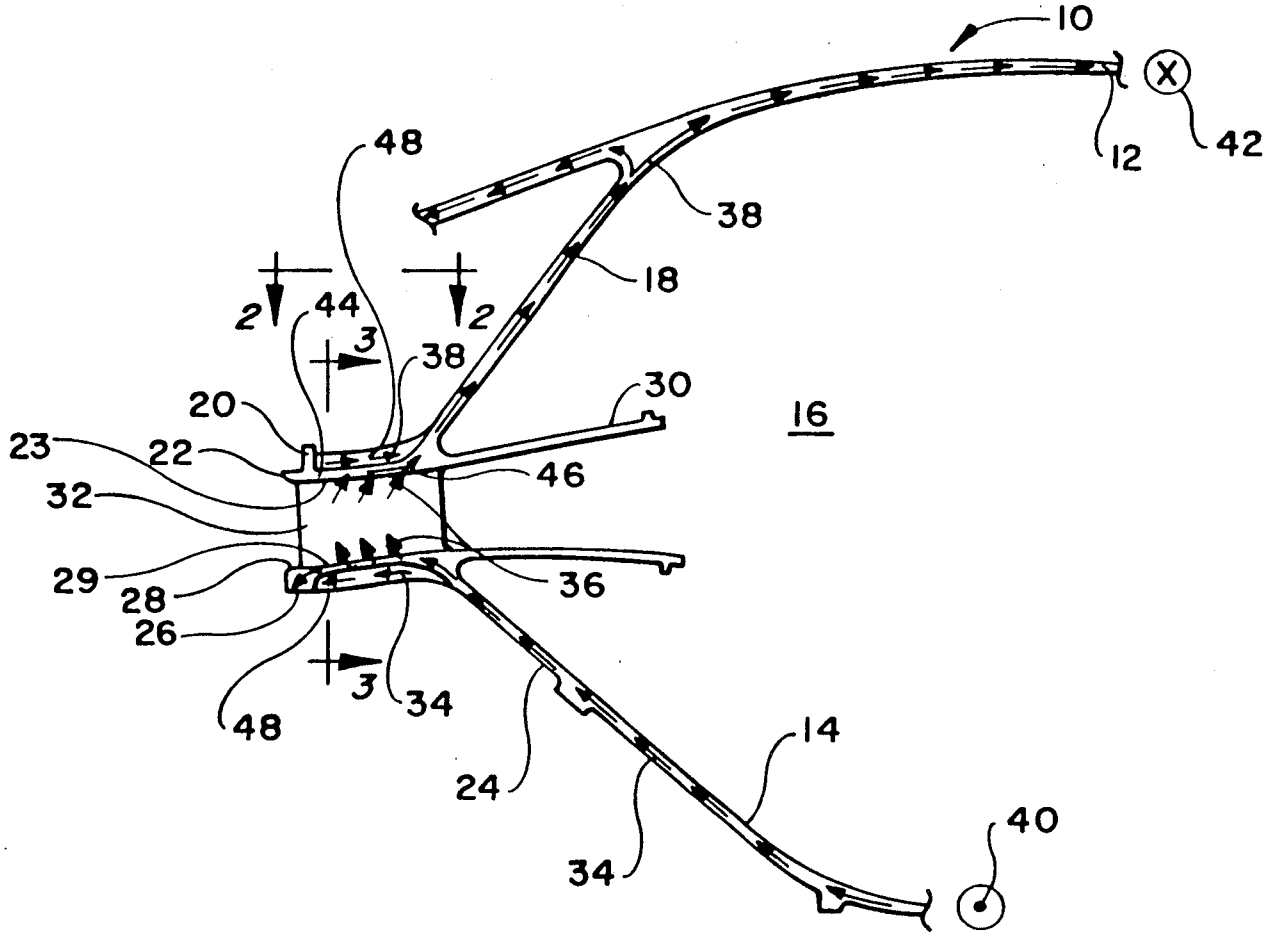
FIG. 1 is a section through the diffuser case.

Referring to FIG. 1, diffuser case 10 is formed of an outer circumferential case 12 and an inner circumferential case 14. An annular diffuser chamber 16 is thereby formed which contains the combustor not shown.

The outer case 10 has a conical outer casing portion 18 at its upstream end with a shroud portion 22 at its ultimate upstream end. A support ring 20 is located on this shroud portion with intermediate shroud portion 23 between the support ring and the conical section.

The inner case 14 has a conical section 24 at its upstream end and a shroud portion 28 at its extreme upstream end. Intermediate shroud portion 29 is located between the ring 26 and the conical portion 24.

Diffuser 30 is formed by extensions of the shroud portion.

A plurality of cambered airfoil vanes 32 are located between and secured to outer case shroud 22 and inner case shroud 28.

Axial loading indicated by lines 34 are imposed on inner shroud portion 28 passing as load lines 36 through the vanes and as load lines 38 through the outer case shroud and the outer case. A tangential or circumferential load 40 is also imposed on the structure with this passing through vanes 32 and being resisted by load 42 of the outer case.

Figure 2A:
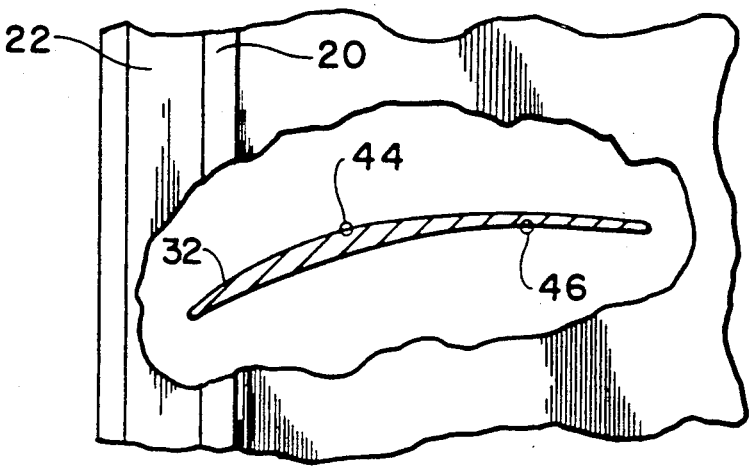
FIG. 2*a* is a view from 2—2 of FIG. 1 with the shroud broken away showing a vane.
Figure 2B:
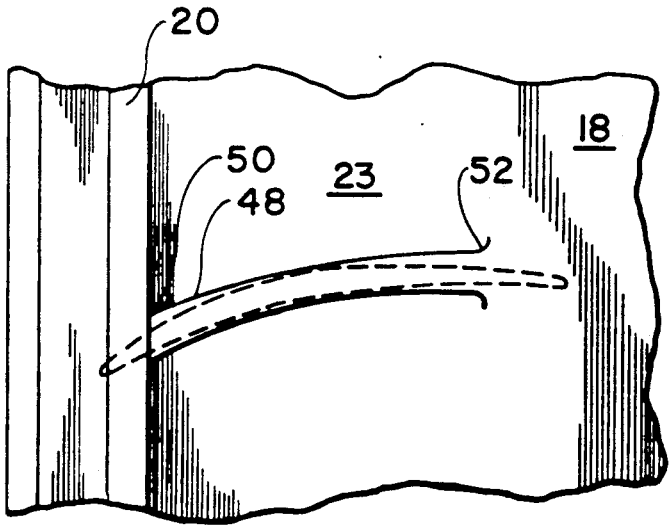
FIG. 2*b* is a view taken at 2—2 of FIG. 1.

It is this loading causing bending of the vanes that establishes high stress at locations 44 and 46 as seen in FIGS. 1 and 2.

Stiffening rib 48 is located coincident with the radial extension of the vanes 32 secured at its upstream end 50 to support ring 20 and fairing into the conical section 18 at location 52. The purpose of these ribs as extensions of the vane is to locally stiffen the junction between the vanes and the shroud so that force may be imposed on the remaining thin shroud to cause its deflection locally. It is noted that the stiffness of ring 20 and conical section 18 does not permit any significant deflection at the ends of the shroud portion. However, deflection is achieved in the intermediate shroud portions 23 and 29 where the high stresses occur on the airfoil vanes.

It has been found that sufficient stiffness can be applied by these ribs to decrease the high stress points of the vane attachment below critical levels while still supplying sufficient strength to transmit axial loads. The thickness of the intermediate shroud portion at the high stress locations should not exceed the maximum thickness of the vanes. It furthermore is preferable that the width of rib 48 not exceed the maximum thickness of the vanes. Furthermore, the height of the ribs should be restricted to not more than four times the thickness of the intermediate shroud portion so as to preclude overstiffening of the structure by these ribs which not would permit the deflection of the shroud intermediate ribs.

Figure 3A:
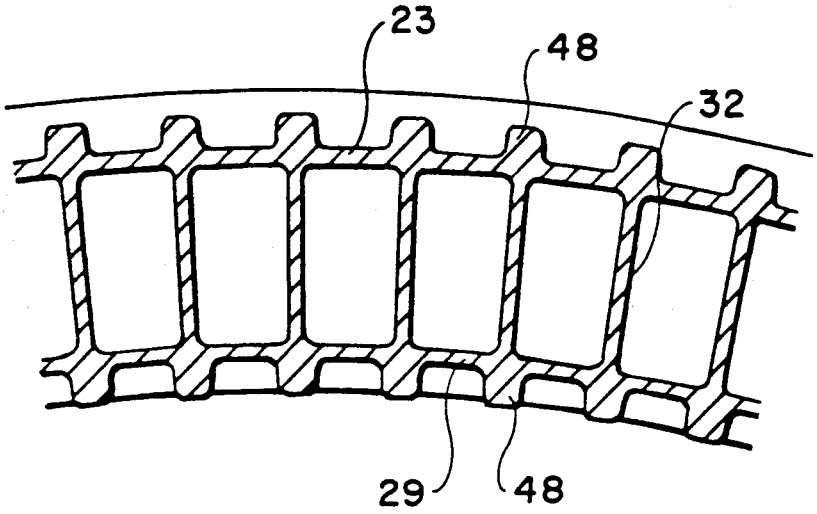
FIG. 3*a* is a nondeflected section through the vanes and shroud taken from 3—3 of FIG. 1.

FIG. 3*a* is a section through the shroud showing the intermediate shroud portion and vanes 32.

Figure 3B:
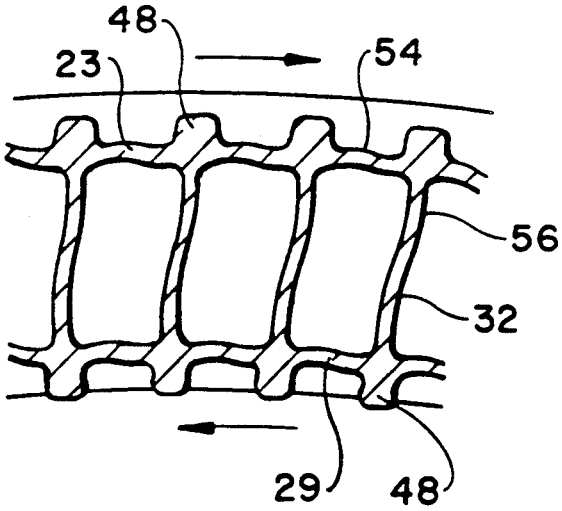
FIG. 3*b* is a deflected section through the vanes and shroud taken through 3—3 of FIG. 1.

Reference to FIG. 3*b* shows the deflected nature of the construction where deflection shown by the s-shape 54 of the intermediate shroud portion 23 permits the end deflection of vanes 32 providing the s-shaped beam structure illustrated as 56. It is noted that the deflection of material is greatly exaggerated for illustrative purposes. It is emphasized that in such a rigid structure even the nominal deflection of the form indicated between the rigid support ring and conical section has been found to be sufficient to reduce the high local stress levels to acceptable levels.

Figure 4:
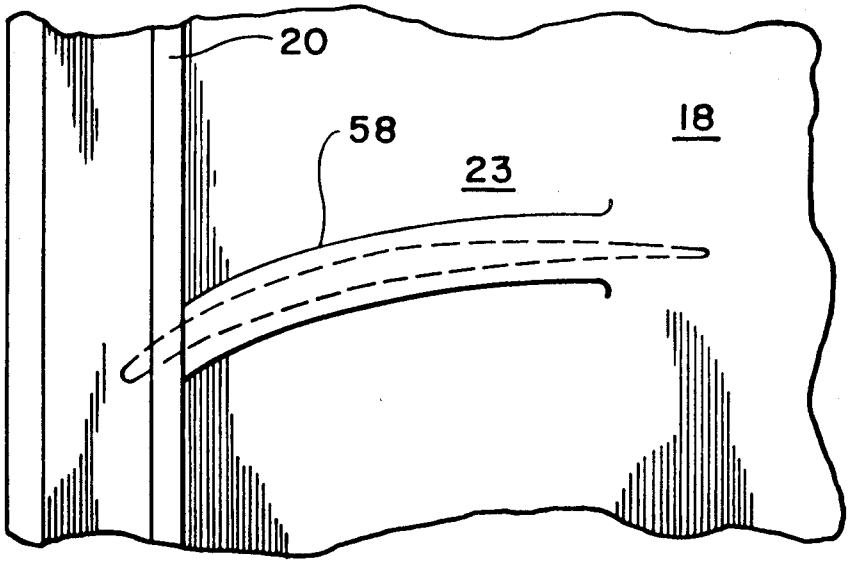
FIG. 4 is a view similar to FIG. 2*b* of an alternate embodiment having thicker ribs.

While the thin rib 48 is the preferable construction, fabrication problems in casting such a thin rib are preferable. Accordingly, FIG. 4 shows an alternate embodiment with a thicker rib 58 which should in no case exceed four times the thickness of the intermediate shroud portion.

We claim:

1. A gas turbine engine case construction comprising:

an inner circumferential case including an inner case shroud portion at the upstream end;

a conical case portion secured to the downstream end of said shroud portion;

a support ring at an upstream end of said shroud portion; and an intermediate shroud portion between said support ring and said conical case portion;

an outer circumferential case including an outer case shroud portion at the upstream end;

a conical outer casing portion secured to the downstream end of said inner case shroud portion, a support ring secured to the upstream end of said shroud portion, and an intermediate shroud portion between said support ring and said conical portion;

a diffuser formed of downstream extensions of said shroud portion;

a plurality of cambered vanes joining said shroud portions axially coextensive with said support ring, said intermediate portion, and a portion of said conical section;

characterized by;

the thickness of said intermediate shroud portion not exceeding the maximum thickness of said vanes; and integral ribs on the side of each intermediate side of each shroud portion away from said vanes, coincident with the radial extension of said vanes.

2. A gas turbine engine case construction as in claim 1:

the width of said ribs not exceeding four times the thickness of said intermediate shroud portion.

3. A gas turbine engine case construction as in claim 2:

the width of said ribs not exceeding the thickness of said intermediate shroud portion.

4. A gas turbine engine case construction as in claim 2:

the height of said ribs not exceeding four times the thickness of said intermediate shroud portion.

5. A gas turbine engine case construction as in claim 3:

the height of said ribs not exceeding four times the thickness of said intermediate shroud portion.

* * * * *